US011455845B2

(12) United States Patent
Yamashita et al.

(10) Patent No.: US 11,455,845 B2
(45) Date of Patent: Sep. 27, 2022

(54) FUEL PROPERTY DIAGNOSTIC DEVICE

(71) Applicant: TOYOTA JIDOSHA KABUSHIKI KAISHA, Aichi-ken (JP)

(72) Inventors: Yoshiya Yamashita, Toyota (JP); Tetsu Yamada, Nagoya (JP)

(73) Assignee: TOYOTA JIDOSHA KABUSHIKI KAISHA, Aichi-ken (JP)

( * ) Notice: Subject to any disclaimer, the term of this patent is extended or adjusted under 35 U.S.C. 154(b) by 0 days.

(21) Appl. No.: 17/179,414

(22) Filed: Feb. 19, 2021

(65) Prior Publication Data

US 2021/0279979 A1 Sep. 9, 2021

(30) Foreign Application Priority Data

Mar. 6, 2020 (JP) ..... JP2020-038370

(51) Int. Cl.

| | |
|---|---|
| ***F01N 3/021*** | (2006.01) |
| ***F01N 11/00*** | (2006.01) |
| ***G07C 5/08*** | (2006.01) |
| ***F02D 41/22*** | (2006.01) |
| ***G07C 5/00*** | (2006.01) |

(52) U.S. Cl.

CPC ..... *G07C 5/0808* (2013.01); *F01N 3/021* (2013.01); *F01N 11/00* (2013.01); *F01N 11/002* (2013.01); *F02D 41/22* (2013.01); *G07C 5/006* (2013.01); *G07C 5/0816* (2013.01); *F02D 2041/224* (2013.01)

(58) Field of Classification Search

CPC ..... F01N 3/021–0296; F01N 11/002; F01N 11/005; F02D 2041/224; G07C 5/006; G07C 5/008; G07C 5/0808; G07C 5/0816

USPC ..... 701/29.3, 29.4, 31.8, 32.1, 34.4

See application file for complete search history.

(56) References Cited

U.S. PATENT DOCUMENTS

| | | | | |
|---|---|---|---|---|
| 8,160,769 | B1 * | 4/2012 | Thompson | G01M 15/05 701/32.8 |
| 2015/0193994 | A1 * | 7/2015 | Mcquade | G07C 5/008 701/29.3 |
| 2017/0009690 | A1 | 1/2017 | Sato et al. | |
| 2017/0182447 | A1 * | 6/2017 | Sappok | G01N 22/00 |
| 2017/0276655 | A1 | 9/2017 | Li | |
| 2019/0293016 | A1 | 9/2019 | Fulton et al. | |

FOREIGN PATENT DOCUMENTS

| | | | |
|---|---|---|---|
| JP | 2015203408 | A | 11/2015 |

* cited by examiner

*Primary Examiner* — Erick R Solis
(74) *Attorney, Agent, or Firm* — Hauptman Ham, LLP

(57) ABSTRACT

A fuel property diagnostic device configured to diagnose properties of fuel for a vehicle includes a computer configured to diagnose the properties of the fuel for each region based on the number of vehicles with clogging. The number of vehicles with clogging is the number of vehicles in which an internal combustion engine provided with an exhaust gas control device in an exhaust passage is mounted, the exhaust gas control device includes a filter for capturing particulate matter contained in an exhaust gas, and the filter is clogged.

3 Claims, 3 Drawing Sheets

FUEL PROPERTY DIAGNOSTIC DEVICE

CROSS-REFERENCE TO RELATED APPLICATION

This application claims priority to Japanese Patent Application No. 2020-038370 filed on Mar. 6, 2020, incorporated herein by reference in its entirety.

BACKGROUND

1. Technical Field

The present disclosure relates to a fuel property diagnostic device.

2. Description of Related Art

As a fuel property diagnostic device of this type, a fuel property diagnostic device for diagnosing properties of fuel for vehicles has been proposed (see, for example, Japanese Unexamined Patent Application Publication No. 2015-203408 (JP 2015-203408 A)). In the device above, the properties of the fuel are diagnosed based on a comparison result between a change timing of an engine operation parameter indicating an operation state of an internal combustion engine and a refueling timing.

SUMMARY

However, although the fuel property diagnostic device above can diagnose the properties of the fuel on a vehicle-by-vehicle basis, it is difficult to diagnose the properties of the fuel on a regional basis. Within the same region, refueling facilities where vehicles can be refueled are limited. Therefore, when the properties of the fuel are not up to a specified standard, other vehicles traveling in the same region are also refueled with a fuel having the non-standard properties. Therefore, there is a high possibility that vehicle failures will occur in groups due to usage of fuel having properties that are not up to the specified standard. Therefore, it is desired to accurately diagnose the properties of the fuel distributed in each region.

The present disclosure provides a fuel property diagnostic device that accurately diagnoses the properties of the fuel distributed in each region.

The fuel property diagnostic device according to an aspect of the present disclosure is a fuel property diagnostic device configured to diagnose properties of fuel for a vehicle. The fuel property diagnostic device includes a computer configured to diagnose the properties of the fuel for each region based on the number of vehicles with clogging. The number of vehicles with clogging is the number of vehicles in which an internal combustion engine provided with an exhaust gas control device in an exhaust passage is mounted, the exhaust gas control device includes a filter for capturing particulate matter contained in an exhaust gas, and the filter is clogged.

In the fuel property diagnostic device according to the aspect of the present disclosure, the properties of the fuel are diagnosed based on the number of vehicles with clogging that is the number of vehicles in which an internal combustion engine provided with an exhaust gas control device in the exhaust passage is mounted, the exhaust gas control device includes a filter for capturing particulate matter contained in an exhaust gas, and the filter is clogged. When the properties of the fuel used for operating the internal combustion engine mounted on the vehicle are not up to a specified standard, the filter that captures the particulate matter in the exhaust gas may be clogged. Therefore, diagnosing the properties of the fuel based on the number of vehicles with clogging for each region makes it possible to accurately diagnose the properties of the fuel distributed in each region.

In the fuel property diagnostic device according to the aspect of the present disclosure, the computer may be configured to diagnose the properties of the fuel in a target region that is subject to diagnostics as not being up to the specified standard when a total number of vehicles that have traveled in the target region exceeds a predetermined number and a ratio of the number of vehicles with clogging to the total number of vehicles exceeds a predetermined ratio. The fuel property diagnostic device according to the aspect of the present disclosure makes it possible to accurately diagnose whether the fuel is not up to the specified standard for each region.

In the fuel property diagnostic device according to the aspect of the present disclosure, the computer may be configured to determine, for each vehicle, whether the filter is clogged based on a differential pressure between an upstream side and a downstream side of the exhaust gas control device in the exhaust passage. The fuel property diagnostic device according to the aspect of the present disclosure makes it possible to appropriately determine whether the filter is clogged for each region.

BRIEF DESCRIPTION OF THE DRAWINGS

Features, advantages, and technical and industrial significance of exemplary embodiments of the present disclosure will be described below with reference to the accompanying drawings, in which like signs denote like elements, and wherein.

DETAILED DESCRIPTION OF EMBODIMENTS

Next, modes for carrying out the present disclosure will be described using an embodiment.

Figure 1:
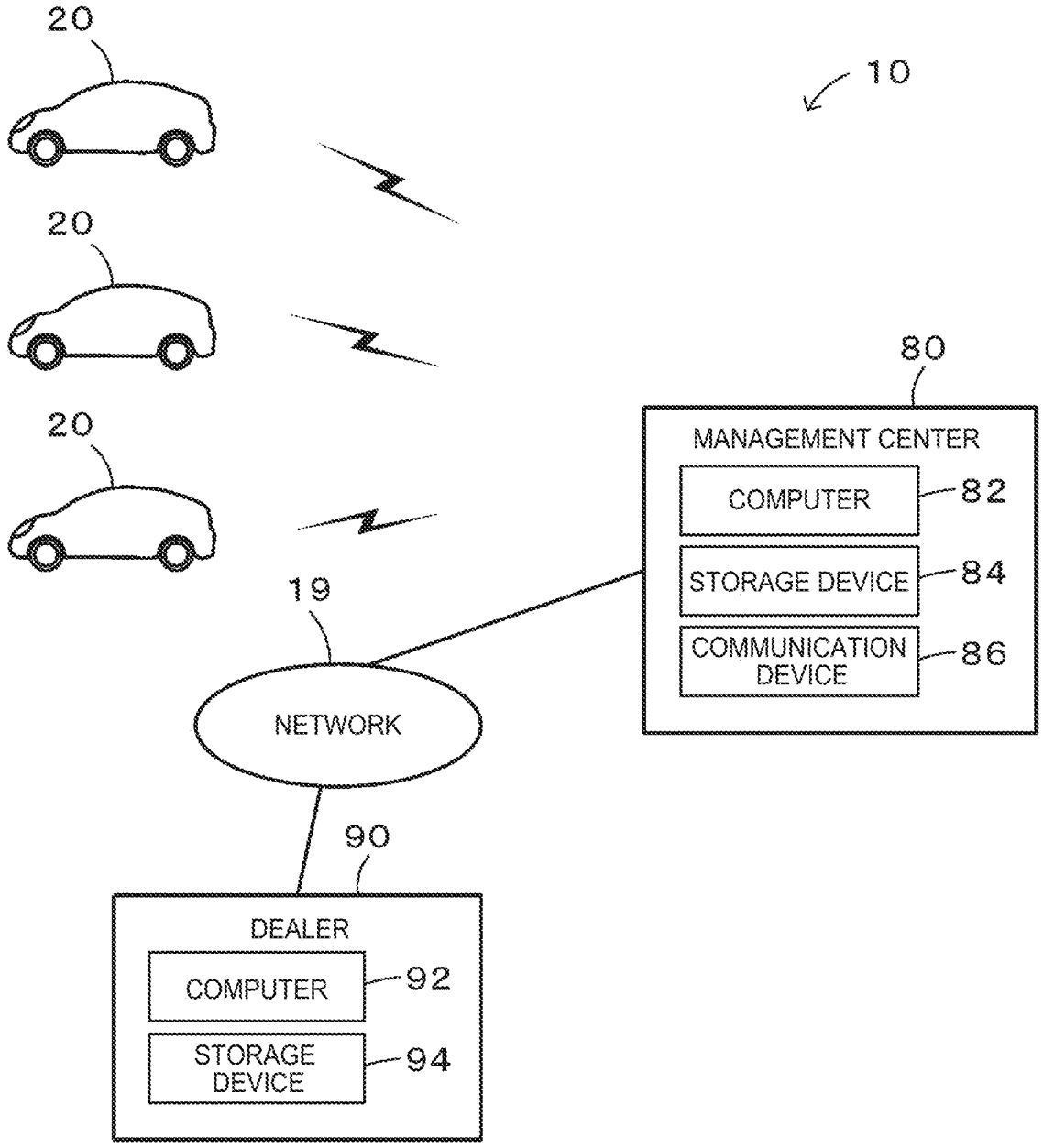
FIG. 1 is a configuration diagram showing an outline of a configuration of a fuel diagnostic system 10 including a fuel property diagnostic device according to an embodiment of the present disclosure.

FIG. 1 is a configuration diagram showing an outline of a configuration of a fuel diagnostic system 10 including a fuel property diagnostic device according to an embodiment of the present disclosure. As shown in FIG. 1, the fuel diagnostic system 10 includes a plurality of hybrid vehicles 20, a management center 80, and a dealer 90.

Figure 2:
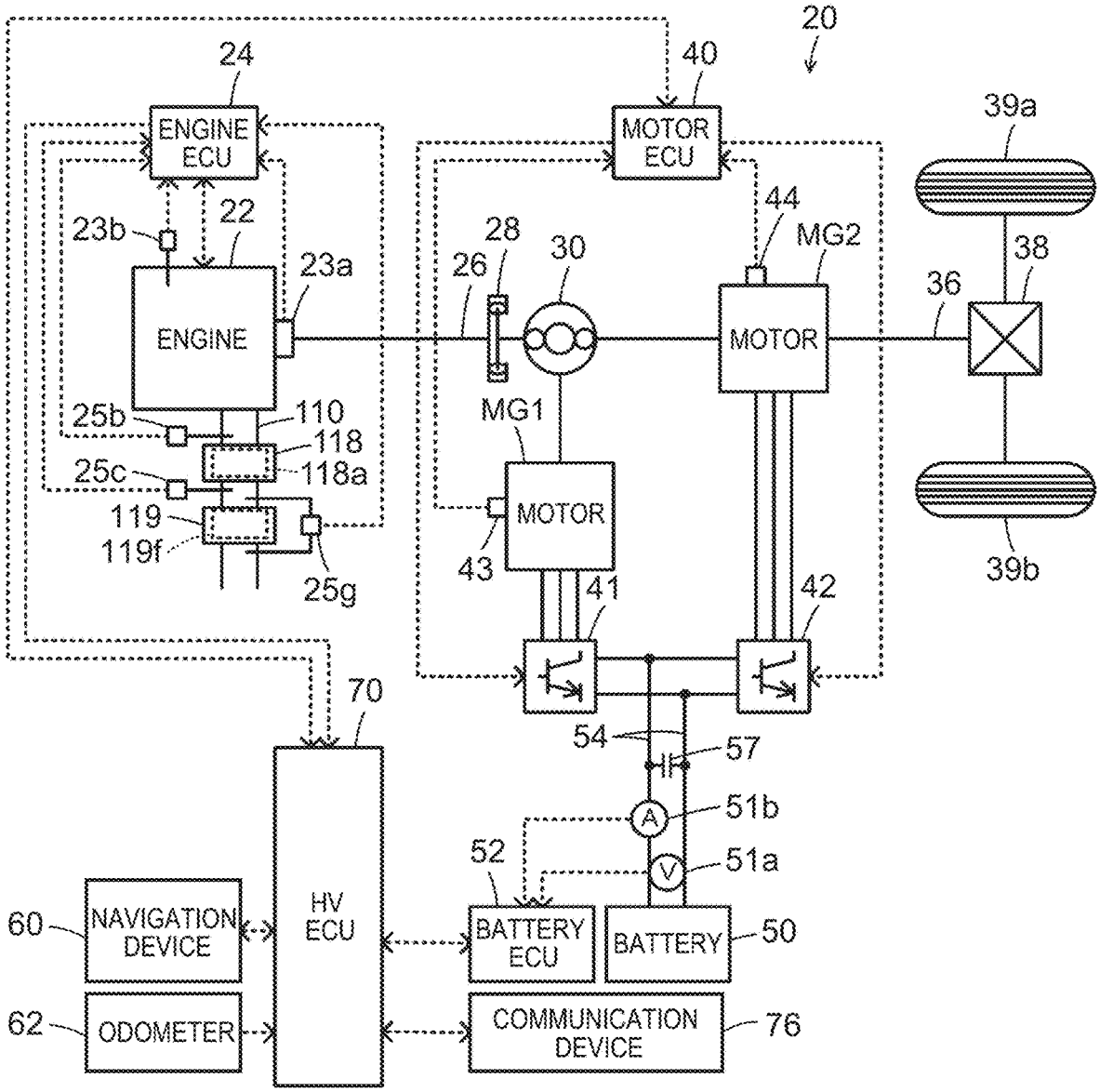
FIG. 2 is a configuration diagram showing an outline of a configuration of a hybrid vehicle 20.

FIG. 2 is a configuration diagram showing an outline of the configuration of each of the hybrid vehicles 20. As shown in FIG. 2, the hybrid vehicle 20 includes an engine 22, a planetary gear 30, motors MG1, MG2, inverters 41, 42, a battery 50, a navigation device 60, and an electronic control unit for a hybrid (hereinafter referred to as an "HV ECU") 70. In the embodiment, the hybrid vehicle 20 can be regarded as a "vehicle".

The engine 22 is configured as an internal combustion engine that outputs power using gasoline or light oil, for example, as fuel, and is connected to a carrier of the planetary gear 30 via a damper 28. An upstream-side exhaust gas control device 118 and a downstream-side exhaust gas control device 119 are provided in an exhaust passage 110 of the engine 22. The upstream-side exhaust gas control device 118 includes a nitrogen oxides (NOx) storage type exhaust gas reduction catalyst (three-way catalyst) 118*a* that reduces harmful components such as carbon monoxide (CO), hydrocarbon (HC), and NOx in the exhaust gas from each cylinder of the engine 22. The downstream-side exhaust gas control device 119 is disposed on a downstream side of the upstream-side exhaust gas control device 118, and includes a particulate filter (GPF) 119*f* that captures particulate matter (fine particles) in the exhaust gas. The particulate filter 119*f* is a porous filter supporting the NOx storage type exhaust gas reduction catalyst (three-way catalyst) made of ceramics and stainless steel, etc. The operation of the engine 22 is controlled by an electronic control unit for an engine (hereinafter, referred to as an "engine ECU") 24. In the embodiment, the engine 22 can be regarded as an "internal combustion engine", and the GPF 119*f* can be regarded as a "filter".

Although not shown, the engine ECU 24 is configured as a microprocessor centered on a central processing unit (CPU), and includes a read-only memory (ROM) for storing a processing program, a random access memory (RAM) for temporarily storing data, an input-output port, and a communication port in addition to the CPU. Signals from various sensors required to control the operation of the engine 22 are input to the engine ECU 24 via the input port. The signals input to the engine ECU 24 include, for example, a crank angle θcr from a crank position sensor 23*a* that detects a rotational position of the crankshaft 26 of the engine 22, and a coolant temperature Tw from a coolant temperature sensor 23*b* that detects a temperature of a coolant of the engine 22. Further, the signals input to the engine ECU 24 also include an air-fuel ratio AF from a air-fuel ratio sensor 25*b* that is installed on an upstream side of the upstream-side exhaust gas control device 118 in an exhaust pipe 117, and an oxygen signal O2 from an oxygen sensor 25*c* that is installed between the upstream-side exhaust gas control device 118 and the downstream-side exhaust gas control device 119 in the exhaust pipe 117. Still further, the signals input to the engine ECU 24 also include a differential pressure ΔP from a differential pressure sensor 25*g* that detects a differential pressure (differential pressure between the upstream side and the downstream side) before and after the downstream-side exhaust gas control device 119. Various control signals for controlling the operation of the engine 22 are output from the engine ECU 24 via the output port.

The planetary gear 30 is configured as a single-pinion type planetary gear mechanism. A sun gear of the planetary gear 30 is connected to a rotor of the motor MG1. A ring gear of the planetary gear 30 is connected to a drive shaft 36 that is connected to drive wheels 39*a*, 39*b* through a differential gear 38. A crankshaft 26 of the engine 22 is connected to a carrier of the planetary gear 30 via a damper 28.

The motor MG1 is configured as, for example, a synchronous generator-motor, and the rotor is connected to the sun gear of the planetary gear 30 as described above. The motor MG2 is configured as, for example, a synchronous generator motor, and the rotor is connected to the drive shaft 36. Inverters 41, 42 are used to drive motors MG1, MG2, and are connected to a battery 50 via power lines 54. A smoothing capacitor 57 is attached to the power lines 54. The motors MG1, MG2 are rotationally driven through switching control of a plurality of switching elements (not shown) of the inverters 41, 42 by an electronic control unit for a motor (hereinafter referred to as a "motor ECU") 40.

Although not shown, the motor ECU 40 is configured as a microprocessor centered on a CPU, and includes a ROM for storing a processing program, a RAM for temporarily storing data, an input-output port, and a communication port, in addition to the CPU. The motor ECU 40 receives, from various sensors via the input port, inputs of signals required to control driving of the motors MG1, MG2, for example, rotation positions θm1, θm2 from rotation position detection sensors 43, 44 that detect rotation positions of the rotors of the motors MG1, MG2. Switching control signals, for example, are output from the motor ECU 40 to the switching elements of the inverters 41, 42 via the output port. The motor ECU 40 is connected to the HV ECU 70 via the communication port.

The battery 50 is configured, for example, as a lithium ion secondary battery or a nickel hydrogen secondary battery, and is connected to the power lines 54. The battery 50 is managed by an electronic control unit for a battery (hereinafter referred to as a "battery ECU") 52.

Although not shown, the battery ECU 52 is configured as a microprocessor centered on a CPU, and includes a ROM for storing a processing program, a RAM for temporarily storing data, an input-output port, and a communication port, in addition to the CPU. Signals from various sensors required to manage the battery 50 are input to the battery ECU 52 via the input port. The signals input to the battery ECU 52 include, for example, a voltage Vb of the battery 50 from a voltage sensor 51*a* installed between terminals of the battery 50 and a current Ib of the battery 50 from a current sensor 51*b* installed to an output terminal of the battery 50. The battery ECU 52 is connected to the HV ECU 70 via the communication port.

Although not shown, a navigation device 60 includes a main body in which a storage medium, such as a hard disk, that stores map information and a control unit provided with an input-output port and a communication port are built, a global positioning system (GPS) antenna that receives information relating to a current location of a host vehicle, and a touch-panel display that displays various types of information such as a planned travel route to a destination and by which a user can input various instructions. Here, service information (for example, tourist information and a parking lot) and road information for each traveling section (for example, traveling sections between traffic lights and between intersections) are stored in the map information as a database. The road information includes, for example, distance information, width information, lane number information, regional information (urban areas and suburbs), road type information (general roads and highways), road gradient information, legal speed limits, and the number of traffic lights. The information relating to the current location of the host vehicle includes a current position Gp including the latitude and longitude of the current location. The navigation device 60 is connected to the HV ECU 70 via the communication port.

Although not shown, the HV ECU 70 is configured as a microprocessor centered on a CPU, and includes a ROM that stores a processing program and a number (hereinafter referred to as a "vehicle number) Vid for identifying a vehicle, a RAM that temporarily stores data, an input-output port, and a communication port, in addition to the CPU. Signals such as a current mileage D1 from the odometer 62 that detects a mileage from the time when the vehicle is manufactured to the current position and a current position Gp from the navigation device 60 are input to the HV ECU 70 via the input port. As described above, the HV ECU 70 is connected to the engine ECU 24, the motor ECU 40, and the battery ECU 52 via the communication port.

The communication device 76 performs external communication with the HV ECU 70.

The management center 80 includes a computer 82 as a management server, a storage device 84, and a communication device 86. The computer 82 includes, for example, a ROM for storing processing programs, a RAM for temporarily storing data, an input-output port, and a communication port, in addition to the CPU. The storage device 84 is configured as, for example, a hard disk and a solid-state drive (SSD). The storage device 84 stores the same map information as the map information stored in the navigation device 60 of the hybrid vehicle 20. The communication device 86 performs external communication with the computer 82. The computer 82, the storage device 84, and the communication device 86 are connected to each other via a signal line. In the embodiment, the computer 82 of the management center 80 may be regarded as a "fuel property diagnostic device".

The dealer 90 is provided with a computer 92 and a storage device 94. In addition to the CPU, the computer 92 includes, for example, a ROM for storing processing programs, a RAM for temporarily storing data, an input-output port, and a communication port. The storage device 94 is configured as, for example, a hard disk and an SSD. The computer 92 and the storage device 94 are connected to each other via a signal line. The computer 92 is connected to the computer 82 of the management center 80 via a network 19, and exchanges various data with the computer 82.

Figure 3:
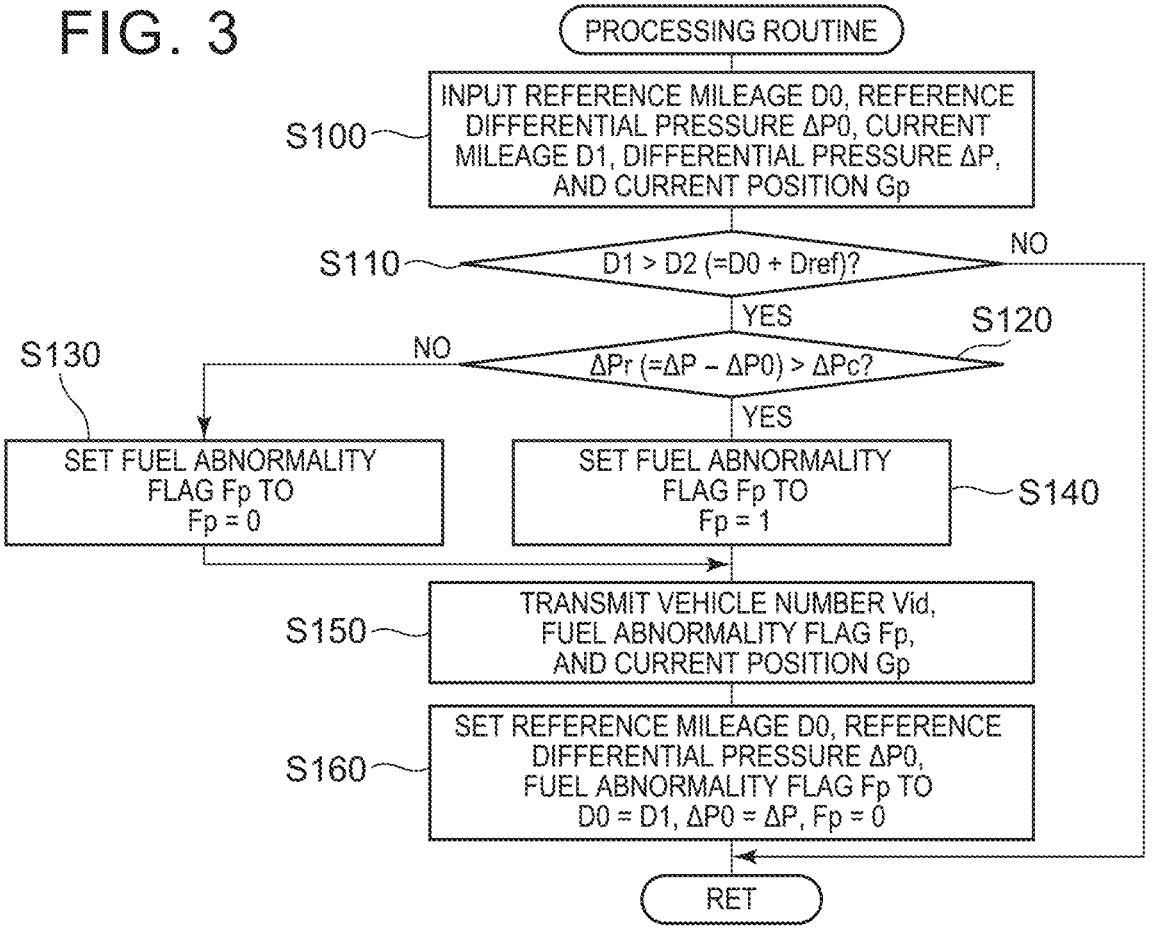
FIG. 3 is a flowchart showing an example of processing executed by an HV ECU 70 of the hybrid vehicle 20.
Figure 4:
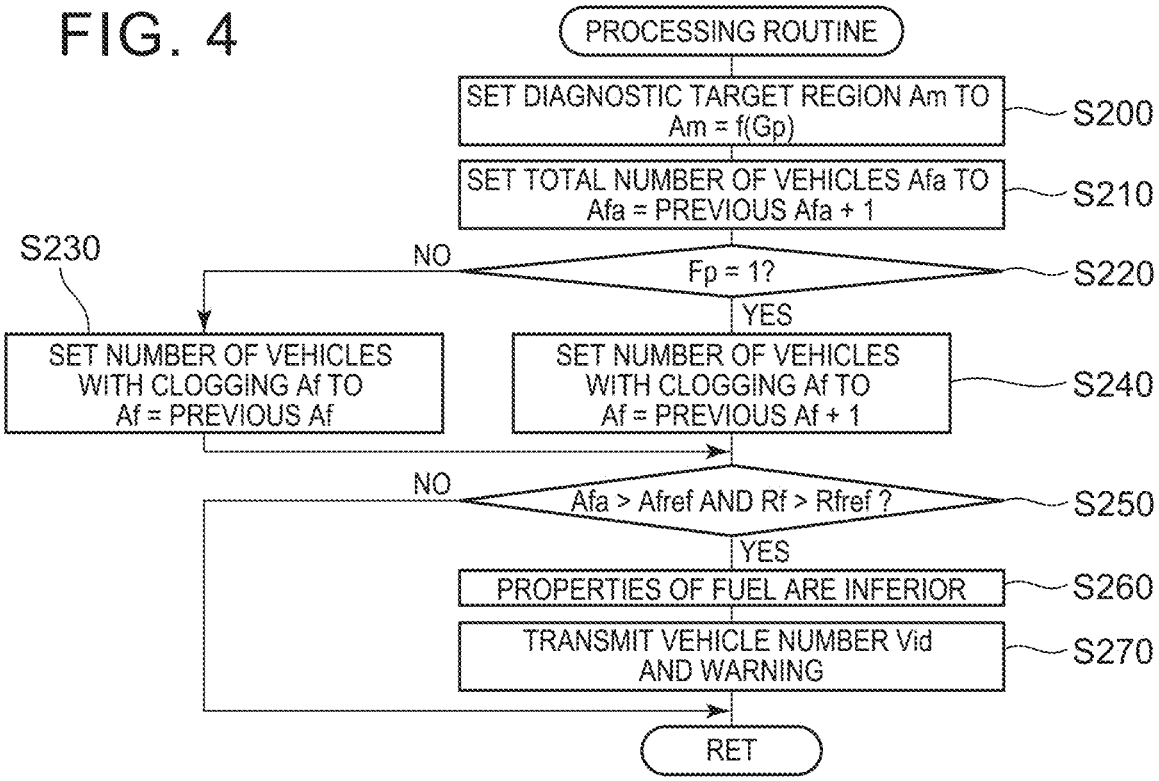
FIG. 4 is a flowchart showing an example of a processing routine executed by a computer 82 of a management center 80.

Next, the operation of the fuel diagnostic system 10 thus configured will be described. FIG. 3 is a flowchart showing an example of processing executed by the HV ECU 70 of the hybrid vehicle 20. FIG. 4 is a flowchart showing an example of a processing routine executed by the computer 82 of the management center 80. The processing routine in FIG. 3 is executed at predetermined time intervals (for example, every several milliseconds). The processing routine in FIG. 4 is executed when the management center 80 receives the vehicle number Vid, a fuel abnormality flag Fp, and the current position Gp from the hybrid vehicle 20. Therefore, the processing routine in FIG. 3 will be described first, and then the processing routine of FIG. 4 will be described.

When the processing routine in FIG. 3 is executed, the CPU of the HV ECU 70 executes processing of inputting a reference mileage D0, a reference differential pressure ΔP0, the current mileage D1, the differential pressure ΔP, and the current position Gp (step S100). The reference mileage D0 is set in step S160 that will be described later. When the routine is first executed, a value 0 is set as an initial value of the reference mileage D0. The reference differential pressure ΔP0 is set in step S160 that will be described later. When the routine is first executed, a value 0 is set as an initial value of the reference differential pressure ΔP0. A value detected by the odometer 62 is input as the current mileage D1. The differential pressure ΔP detected by the differential pressure sensor 25g is input via the engine ECU 24. The current position Gp is input from the navigation device 60.

When the data is input as described above, next, the HV ECU 70 determines whether the current mileage D1 exceeds a threshold value D2 (=D0+Dref) obtained by adding a determination interval Dref (for example, 800 km, 1000 km, or 1200 km) to the reference mileage D0 (step S110). When the current mileage D1 is equal to or less than the threshold value D2, the routine is terminated.

When the current mileage D1 exceeds the threshold value D2 in step S110, next, the reference differential pressure ΔP0 is subtracted from the differential pressure ΔP to determine whether an increase amount ΔPr (=ΔP−ΔP0) of the differential pressure ΔP before and after the downstream-side exhaust gas control device 119 exceeds a threshold value ΔPc (for example, 10 kPa, 20 kPa, or 30 kPa) (step S120). The threshold value ΔPc is a threshold value for determining whether the GPF 119f is clogged. It is considered that the GPF 119f is clogged when the properties of the fuel are not up to the specified standard and inferior in quality. Therefore, the processing in step S120 is processing of determining whether the properties of the fuel are not up to the specified standard and inferior in quality.

When the increase amount ΔPr is equal to or less than the threshold value ΔPc in step S120, the HV ECU 70 determines that the properties of the fuel are up to the standard, and a value 0 is set to the fuel abnormality flag Fp (step S130). When the increase amount ΔPr exceeds the threshold value ΔPc in step S120, the HV ECU 70 determines that the properties of the fuel are not up to the specified standard and inferior in quality, and a value 1 is set to the fuel abnormality flag Fp (step S140).

When the fuel abnormality flag Fp is set as described above, the vehicle number Vid stored in the ROM, the fuel abnormality flag Fp, and the current position Gp are transmitted to the management center 80 via the communication device 76 (step S150). The current mileage D1 is set as the reference mileage D0, the differential pressure ΔP is set as the reference differential pressure ΔP0, and the fuel abnormality flag Fp is reset to a value 0 (step S160). The processing routine is then terminated.

Next, the processing routine in FIG. 4 executed by the computer 82 of the management center 80 will be described. The processing routine in FIG. 4 is executed when the computer 82 inputs, via the communication device 86, the vehicle number Vid, the fuel abnormality flag Fp, and the current position Gp transmitted from the communication device 76 of the hybrid vehicle 20.

When the processing routine in FIG. 4 is executed, the computer 82 of the management center 80 sets, as a diagnostic target region Am, a region where the hybrid vehicle 20 that has transmitted the vehicle number Vid, the fuel abnormality flag Fp, and the current position Gp is currently located, based on the current position Gp (step S200). The diagnostic target region Am is one of a plurality of regions predetermined with each city or village being as a unit region based on the map information stored in the storage device 84.

Next, a total number of vehicles Afa of the hybrid vehicles 20 that have transmitted the fuel abnormality flag Fp within the diagnostic target region Am is set (step S210). The total number of vehicles Afa is set by adding the value 1 to the total number of vehicles Afa (previous Afa) that is set before executing the routine. The total number of vehicles Afa is set to the value 0 as an initial value.

Subsequently, the computer 82 determines whether the input fuel abnormality flag Fp has the value 1 (step S220), and sets a total number Af (the number of vehicles with clogging) of hybrid vehicles 20 that have transmitted the fuel abnormality flag Fp having the value 1 in the diagnostic target region Am up to the current time point (steps S230 and S240). When the fuel abnormality flag Fp is not the value 1 in step S220, the total number (previous Af) of hybrid vehicles 20 that have transmitted the fuel abnormality flag Fp having the value 1 before executing the routine in the diagnostic target region Am is set as the number of vehicles with clogging Af (step S230). When the fuel abnormality flag Fp has the value 1, a value in which the value 1 is added to the previous Af is set as the number of vehicles with clogging Af (step S240).

When the total number of vehicles Afa and the number of vehicles with clogging Af are set as described above, the computer 82 determines whether the total number of vehicles Afa exceeds a predetermined number Afref and whether a ratio Rf (=Af/Afa) of the number of vehicles with clogging Af to the total number of vehicles Afa exceeds a predetermined ratio Rfref (step S250). The predetermined number Afref is a threshold value for determining whether the total number of vehicles Afa has reached the number of vehicles that allows appropriate determination of the properties of the fuel distributed in the diagnostic target region Am. The predetermined number Afref is set to, for example, 100 units, 200 units, or 300 units, in consideration of statistic errors. The predetermined ratio Rfref is a threshold value for determining whether the properties of the fuel distributed in the diagnostic target region Am are not up to the standard and inferior in quality. The predetermined ratio Rfref is set to, for example, 0.5, 0.6, or 0.7.

When the total number of vehicles Afa is equal to or less than the predetermined number Afref in step S250, or when the ratio Rf is equal to or less than the predetermined ratio Rfref even if the total number of vehicles Afa exceeds the predetermined number Afref, the computer 82 determines that the total number of vehicles Afa has not reached the number of vehicles that allows appropriate determination of the properties of the fuel distributed in the diagnostic target region Am or the properties of the fuel distributed in the diagnostic target region Am are up to the standard, and terminates the routine.

When the total number of vehicles Afa exceeds the predetermined number Afref in step S250 and the ratio Rf exceeds the predetermined ratio Rfref, the computer 82 determines that the properties of the fuel distributed in the diagnostic target region Am are not up to the specified standard and inferior in quality (step S260). The computer 82 then transmits the input vehicle number Vid and warning information indicating that the properties of the fuel distributed in the diagnostic target region Am are not up to the specified standard to the dealer 90 (step S270), and terminates the routine. With the processing above, the properties of the fuel distributed in each region can be accurately determined by diagnosing the properties of the fuel distributed in each diagnostic target region Am.

The computer 92 of the dealer 90 that has received the vehicle number Vid and the warning information stores the received vehicle number Vid and warning information in the storage device 94. The processing routine in FIG. 4 is executed every time the computer 82 of the management center 80 inputs, via the communication device 86, the vehicle number Vid, the fuel abnormality flag Fp, and the current position Gp transmitted from the communication device 76 of the hybrid vehicle 20. Therefore, the storage device 94 of the dealer 90 stores an abnormality occurrence region Aab where the properties of the fuel distributed in the region are not up to the specified standard and the vehicle number Vid of the hybrid vehicle 20 that has been in the abnormality occurrence region Aab.

As described above, the storage device 94 of the dealer 90 accumulates information on the abnormality occurrence region Aab and the vehicle number Vid of the hybrid vehicle 20 that has been in the abnormality occurrence region Aab. When the hybrid vehicle 20 receives servicing at the dealer 90 for a periodical check-up, etc. and the vehicle number Vid is input to the computer 92 of the dealer 90, the computer 92 checks the input vehicle number Vid with the vehicle number Vid stored in the storage device 94. When the input vehicle number Vid of the hybrid vehicle 20 matches the vehicle number Vid stored in the storage device 94, a maintenance request is displayed on a display (not shown) such that maintenance such as cleaning of a combustion chamber and the exhaust passage 110 of the engine 22 or a check-up of the combustion chamber and the exhaust passage 110 of the engine 22 is conducted. At the dealer 90 that receives the maintenance request, the maintenance or the check-up of the combustion chamber and the exhaust passage 110 of the engine 22 is conducted, which suppresses occurrence of a failure of the hybrid vehicle 20 due to the properties of the fuel being not up to the specified standard.

In the fuel diagnostic system 10 including the fuel property diagnostic device according to the embodiment that has been described above, the engine 22 in which the downstream-side exhaust gas control device 119 provided with the GPF 119*f* is installed to the exhaust passage 110 is mounted in the hybrid vehicle 20, and the properties of the fuel is diagnosed based on the number of vehicles with clogging Af indicating the number of the hybrid vehicles 20 in which the GPF 119*f* is clogged. With this configuration, the properties of the fuel distributed in each region can be accurately diagnosed.

Further, in the diagnostic target region Am, when the total number of vehicles Afa exceeds the predetermined number Afref and the ratio Rf of the number of vehicles with clogging Af to the total number of vehicles Afa exceeds the predetermined ratio Rfref, the fuel distributed in the diagnostic target region Am is determined to be not up to the specified standard. Therefore, whether the fuel is not up to the specified standard can be accurately diagnosed.

Further, the HV ECU 70 determines whether the GPF 119*f* is clogged based on the differential pressure ΔP for each of the hybrid vehicles 20. Accordingly, whether the GPF 119*f* is clogged can be appropriately determined.

In the fuel diagnostic system 10 including the fuel property diagnostic device according to the embodiment, the computer 82 determines, in step S250 of the processing routine shown in FIG. 4, whether the total number of vehicles Afa exceeds the predetermined number Afref and whether the ratio Rf of the number of vehicles with clogging Af to the total number of vehicles Afa exceeds the predetermined ratio Rfref. However, the determination in step S250 may only be made based on the number of vehicles with clogging Af. Therefore, for example, whether the number of vehicles with clogging Af exceeds the predetermined number Afref (for example, 100 units, 200 units, or 300 units) may be determined. In this case, the determination only needs to be made that the properties of the fuel distributed in the diagnostic target region Am are not up to the specified standard when the number of vehicles with clogging Af exceeds the predetermined number Afref.

In the fuel diagnostic system 10 including the fuel property diagnostic device according to the embodiment, the processing routine in FIG. 4 is executed by the computer 82 of the management center 80. However, a part or all of the processing routine in FIG. 4 may be executed by the computer 92 of the dealer 90 or may be executed in the hybrid vehicle 20.

In the fuel diagnostic system 10 including the fuel property diagnostic device according to the embodiment, the hybrid vehicle 20 is provided with the engine 22 including the GPF 119*f*. However, the engine 22 may be a diesel engine including a diesel particulate filter (DPF).

In the embodiment, a case where the present disclosure is applied to the fuel diagnostic system 10 including the hybrid vehicle 20 is illustrated. However, the present disclosure may be applied to any mode of vehicles as long as the vehicles include the engine 22 in which the exhaust gas control device having GPF 119*f* is installed in the exhaust passage 110. For example, instead of the hybrid vehicle 20, the present disclosure may be applied to a mode of a hybrid vehicle having a configuration in which the motors MG1, MG2 and the planetary gear 30 are not provided but the engine 22 including the exhaust gas control device having the GPF 119*f* in the exhaust passage 110 and a motor including a rotation shaft connected to the crankshaft 26 of the engine 22 via a clutch and also connected to the drive shaft 36 are provided. The present disclosure may be applied to a mode of a vehicle having a configuration in which the motors MG1, MG2 and the planetary gear 30 are not provided but the engine 22 including the exhaust gas control device having the GPF 119*f* in the exhaust passage 110 and a transmission connected to the crankshaft 26 of the engine 22 and the drive shaft 36 are provided.

In the embodiment, a case where the present disclosure is applied to the fuel diagnostic system 10 including the plurality of hybrid vehicles 20, the management center 80, and the dealer 90 is illustrated. However, the present disclosure may be applied to a fuel diagnostic system not including the management center 80 and including the hybrid vehicles 20 and the dealer 90, and a fuel diagnostic system not including the dealer 90 and including the hybrid vehicles 20 and the management center 80.

The correspondence between the main elements of the embodiment and the main elements of the present disclosure described in the summary is an example for specifically describing a mode for carrying out the present disclosure described in the summary Therefore, the embodiment does not limit the elements of the present disclosure described in the summary That is, the interpretation of the present disclosure described in the summary should be carried out based on the description in the summary, and the embodiment is merely a specific example of the present disclosure described in the summary.

Although the mode for carrying out the present disclosure has been described above with reference to the embodiment, the applicable embodiment is not limited to the embodiment, and the present disclosure may be carried out in various modes without departing from the gist of the present disclosure.

The present disclosure can be used in, for example, the manufacturing industry of the fuel property diagnostic device.

What is claimed is:

1. A fuel property diagnostic device configured to diagnose properties of fuel for a vehicle, the fuel property diagnostic device comprising:

a computer configured to diagnose the properties of the fuel for each region based on the number of vehicles with clogging, wherein the number of vehicles with clogging is the number of vehicles in which an internal combustion engine provided with an exhaust gas control device in an exhaust passage is mounted, the exhaust gas control device includes a filter for capturing particulate matter contained in an exhaust gas, and the filter is clogged.

2. The fuel property diagnostic device according to claim 1, wherein the computer is configured to diagnose the properties of the fuel in a target region that is subject to diagnostics as not being up to a specified standard when a total number of vehicles that have traveled in the target region exceeds a predetermined number and a ratio of the number of vehicles with clogging to the total number of vehicles exceeds a predetermined ratio.

3. The fuel property diagnostic device according to claim 1, wherein the computer is configured to determine, for each vehicle, whether the filter is clogged based on a differential pressure between an upstream side and a downstream side of the exhaust gas control device in the exhaust passage.

* * * * *